United States Patent [19]

Lieberman

[11] 4,218,781

[45] Aug. 26, 1980

[54] ATHLETIC APPAREL

[76] Inventor: Mark Lieberman, 27 Bayfield Rd., Wayland, Mass. 01778

[21] Appl. No.: 832

[22] Filed: Jan. 4, 1979

[51] Int. Cl.[2] ..... A41D 27/20; A41F 9/00

[52] U.S. Cl. ..... 2/247; 2/238

[58] Field of Search ..... 2/247, 249, 238, 53, 2/54, 55, 56

[56] References Cited

U.S. PATENT DOCUMENTS

| | | | |
|---|---|---|---|
| 500,926 | 4/1893 | Moschcowitz | 2/53 |
| 3,438,062 | 4/1969 | Dobell | 2/247 |
| 3,537,108 | 11/1970 | Daniels | 2/247 |
| 3,588,916 | 6/1971 | Glatt | 2/53 |
| 3,611,444 | 10/1971 | Rector | 2/247 |
| 3,840,901 | 10/1974 | Eyster | 2/247 |

*Primary Examiner*—Doris L. Troutman
*Attorney, Agent, or Firm*—John E. Toupal

[57] ABSTRACT

Disclosed is athletic apparel comprising an article of clothing to be worn by a participant in an athletic endeavor, a moisture absorbent pad for absorbing perspiration collected on the hands of the participant and fastening means for removably attaching the moisture absorbent pad to the article of clothing. The fastening means includes fastener elements secured to one side of the absorbent pad adjacent a plurality of edges thereof and mating elements secured at spaced apart locations on the outer surface of the clothing and adapted to detachably engage the fastener elements so as to secure the opposite edges of the absorbent pad in a substantially planar orientation on the outer surface of the clothing.

6 Claims, 6 Drawing Figures

ATHLETIC APPAREL

BACKGROUND OF THE INVENTION

This invention relates generally to an article of athletic apparel and, more particularly, to an article of athletic apparel that includes a moisture absorbent pad for absorbing perspiration from the hands of a participant wearing the apparel.

In many active sports, particularly those in which a racquet is employed such as tennis and racquetball, the perspiration on a participant's hands is troublesome and can result in a deterioration of his performance. Athletes confronted with this problem have previously resorted to accessories such as absorbent wristbands and towels. However, wristbands generally fail to prevent a buildup of perspiration on a participant's hands and the use of towels retained in positions removed from a field of play are accessible only during a hiatus in the contest. In attempts to alleviate this latter problem, many athletes carry towels or other moisture absorbent items with them when actually engaged in the athletic event. Typically, this is accomplished by carrying a towel on the participant's clothing, for example, by insertion into a pocket or behind the waistband of a pair of shorts. These attempts to solve the perspiration buildup problem are generally less than satisfactory for a variety of reasons. For example, a towel loosely held by the waistband of a participant's shorts tends to flop around during required movement by the participant and can thereby interfere with play. Also, towels or absorbent pads carried directly on the athlete's clothing tend to become saturated with body perspiration and thereby useless for the removal of moisture from the athlete's hands.

The object of this invention, therefore, is to provide an article of athletic apparel that can be utilized to remove perspiration from a wearer's hands during participation in an athletic contest and which does not impede or in any way interfere with play.

SUMMARY OF THE INVENTION

The subject of the present invention is athletic apparel comprising an article of clothing to be worn by a participant in an athletic endeavor, a moisture absorbent pad for absorbing perspiration collected on the hands of the participant and fastening means for removably attaching the moisture absorbent pad to the article of clothing. The fastening means includes fastener elements secured to one side of the absorbent pad adjacent a plurality of edges thereof and mating elements secured at spaced apart locations on the outer surface of the clothing and adapted to detachably engage the fastener elements so as to secure the opposite edges of the absorbent pad in a substantially planar orientation on the outer surface of the clothing. The absorbent pad is readily available for drying the hands of the participant and the fastening of the pads along a plurality of edges insures that the pad will remain substantially immobile relative to the supporting clothing and thereby not interfere with play.

A preferred embodiment of the invention includes a sheet of moisture impervious material secured to the absorbent pad and substantially covering the side thereof to which the fasteners are attached. The moisture impervious material prevents saturation of the absorbent pad by the wearer's body perspiration.

According to one feature of the invention, the fastener elements are secured to adjoining edges on the absorbent pad and the mating elements on the article of clothing are arranged to support the pad in the form of a pocket. This arrangement permits use of the absorbent pad for the removal of perspiration and additionally as a pocket for holding items such as balls used during play.

According to another feature of the invention, the pad comprises two separate layers of absorbent material joined along those adjacent edges to form a pocket. This feature in conjunction with the immediately preceding feature provides the user with the additional flexibility of a double pocket for holding items desired during play.

DESCRIPTION OF THE DRAWINGS

These and other objects and features of the present invention will become more apparent upon a perusal of the following description taken in conjunction with the accompanying drawings wherein.

DESCRIPTION OF THE PREFERRED EMBODIMENTS

Figure 1:
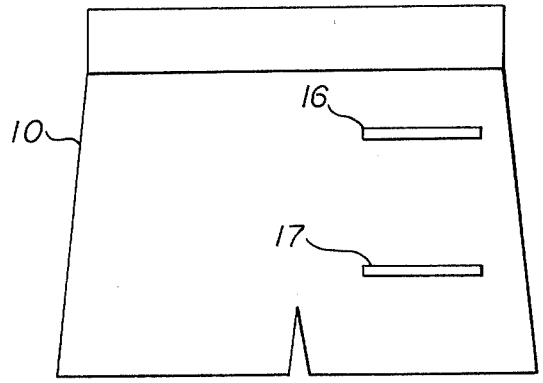
FIG. 1 is a schematic view of a pair of athletic shorts.
Figure 2:
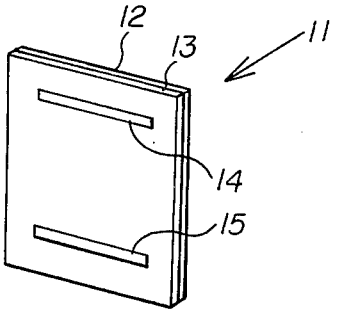
FIG. 2 is a schematic perspective view of an absorbent pad accessory for attachment to the shorts shown in FIG. 1.

Referring now to FIG. 1, there is schematically illustrated a pair of athletic shorts 10 of the type typically used by participants of athletic contests such as tennis and racquetball. An accessory 11 for use with the shorts 10 is schematically shown in FIG. 2 and comprises a rectangular pad 12 made of a highly moisture absorbent material such as terry cloth. Completely covering one side of the absorbent pad 12 is a sheet 13 of moisture impervious material such as plastic. The sheet 13 is attached to the pad by any conventional process such as by stitching or by use of a suitable adhesive. A pair of fastening element strips 14 and 15 are secured to the sheet 13 adjacent opposite edges of the pad 12. Preferably, the fastener elements 14 and 15 are material strips of the type sold under the trademark Velcro and are also secured by an conventional method such as by stitching or a suitable adhesive. Similarly secured to spaced apart locations on the outer surface of a pair of shorts 10 are mating Velcro fastener elements 16 and 17. As is well known, the Velcro fastener element strips 14 and 15 become removably engaged with the mating fastener strips 16 and 17 upon contact therebetween. The spacing between the mating elements 16 and 17 is equal to the spacing between the fastener elements 14 and 15 so as to maintain the pad in a substantially planar orientation upon the outer surface of the shorts 10.

A participant wearing the shorts 10 participating in a strenuous athletic endeavor such as tennis or racquetball can utilize the attached absorbent pad 12 to remove perspiration from his hands. Conversely, the moisture impervious sheet 13 prevents saturation of the pad by perspiration passing from the wearer's body through the shorts 10. Once the pad 12 has become thoroughly saturated so as to be ineffective for absorbing perspiration, the accessory 11 can be easily removed by merely pulling apart the fastener strips 14–17 and replaced by a fresh accessory. It will be obvious that the mating fastener strips 16 and 17 can be secured to either the front or rear side of the shorts 10 depending upon personal preference.

Figure 3:
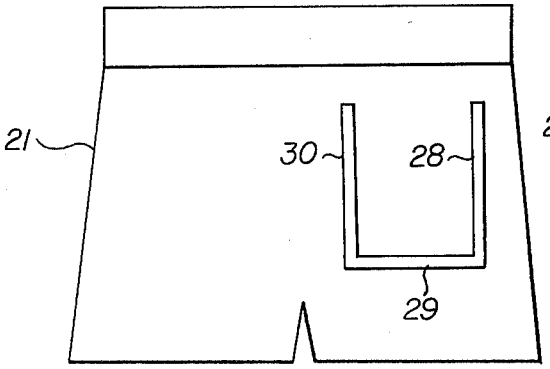
FIG. 3 is a schematic view of another pair of athletic shorts.
Figure 4:
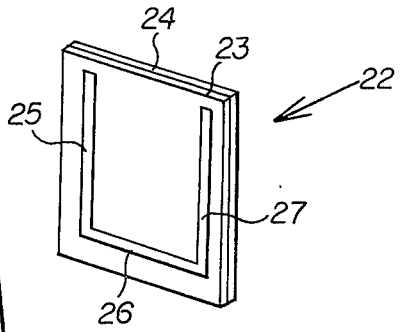
FIG. 4 is a schematic view of an absorbent pad accessory for attachment to the athletic shorts shown in FIG. 3.
Figure 6:
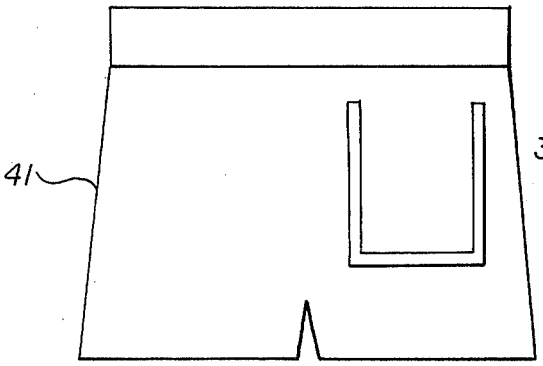

Referring now to FIGS. 3 and 4, there are schematically shown a pair of shorts 21 and an accessory 22 therefor forming a modified embodiment of the invention. Again a moisture impervious sheet 23 is secured to one side of an absorbent pad 24. However, in this embodiment fastener element strips 25–27 are secured to the sheet 23 adjacent three adjoining edges of the absorbent pad 24 in an upwardly facing U form. Similarly, mating fastener strips 28, 29 and 30 are secured to the outer surface of the shorts 21. The embodiment illustrated in FIGS. 3 and 4 is utilized in the same manner as the embodiment shown in FIGS. 1 and 2. However, this engagement of the fastener elements 25–27 with the mating elements 28–30 forms a pocket on the surface of the shorts 21 that can be utilized by the wearer for any desired purpose such as holding balls.

Figure 5:
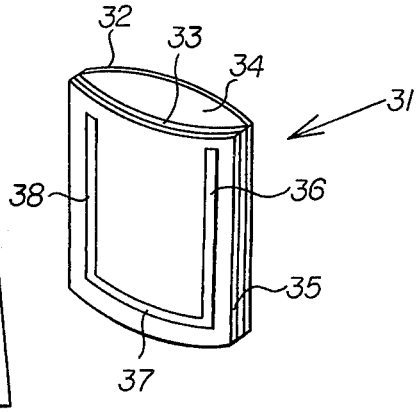
FIG. 5 is a schematic perspective view of a modified absorbent pad accessory for attachment to the athletic shorts shown in FIG. 3.

FIG. 5 schematically illustrates still another accessory 31 for use with the shorts shown in FIG. 3. The accessory 31 is formed by a pair of absorbent pads 32 and 33 joined, for example by stitching, along three edges so as to form a pocket 34. Again a moisture impervious sheet 35 is secured to one side of one of the absorbent pads 33 and fastener element strips 36, 37 and 38 are secured to the sheet 35 along three adjoining edges thereof. The accessory 31 is utilized in the same manner as is the accessory 22 shown in FIG. 4. However, the accessory 31 provides the wearer of the shorts 21 with an additional pocket 34 in addition to the pocket formed by the fastening elements 36–38. The additional pocket 34 can be used, for example, to retain rosin and to simultaneously absorb moisture from both sides of a player's hand.

Obviously, many modifications and variations of the present invention are possible in light of the above teachings. For example, the moisture impervious sheet 13, 23 or 35 can be attached directly to the shorts rather than to the absorbent pad. In that case the mating elements would be secured to the outer surface of the impervious sheet and the fastener elements would be secured directly to the absorbent pad. Also a triangular shaped pocket can be formed with fastener elements secured adjacent to only two edges of the absorbent pad. It is to be understood, therefore, that the invention can be practiced otherwise than as specifically described.

What is claimed is:

1. Athletic apparel comprising:

an article of clothing to be worn by a participant in an athletic endeavor;

a moisture absorbent pad for absorbing perspiration collected on the hands of the participant;

fastening means for removably attaching said moisture absorbent pad to said article of clothing, said fastening means comprising fastener elements secured along adjoining edges on one side of said absorbent pad, and mating elements secured at spaced apart locations on the outer surface of said article of clothing and arranged thereon so as to support said pad in the form of a pocket on said article of clothing, said mating elements detachably engaging said fastener elements to secure said adjoining edges of said absorbent pad in a substantially planar orientation on the outer surface of said article of clothing; and a sheet of moisture impervious material positioned between said outer surface and said absorbent pad and substantially covering said one side thereof so as to prevent body moisture from passing through said article of clothing to said pad.

2. Athletic apparel according to claim 1 wherein said pad is rectangular in form and said fastener elements are secured adjacent to three edges of an upwardly opening U form.

3. Athletic apparel according to claim 2 wherein said fastener and mating elements comprise hook and pile fastener strips.

4. Athletic apparel according to claim 2 wherein said pad comprises two separate layers of material joined along adjacent edges thereof so as to form a pocket.

5. Athletic apparel according to claim 4 wherein said fastener and mating elements comprise hook and pile fastener strips.

6. Athletic apparel according to claim 1 wherein said article of clothing is a pair of athletic shorts.

* * * * *